US008479419B2

(12) United States Patent
Chadha

(10) Patent No.: US 8,479,419 B2
(45) Date of Patent: Jul. 9, 2013

(54) STEAMING DEVICE WITH A RINSING FEATURE

(75) Inventor: Jasmeet Singh Chadha, London (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 369 days.

(21) Appl. No.: 12/744,358

(22) PCT Filed: Nov. 27, 2008

(86) PCT No.: PCT/IB2008/054992

§ 371 (c)(1),
(2), (4) Date: May 24, 2010

(87) PCT Pub. No.: WO2009/069099

PCT Pub. Date: Jun. 4, 2009

(65) Prior Publication Data

US 2010/0229434 A1 Sep. 16, 2010

(30) Foreign Application Priority Data

Nov. 30, 2007 (EP) ..... 07121942

(51) Int. Cl.
*D06F 75/18* (2006.01)
*D06F 75/08* (2006.01)

(52) U.S. Cl.
USPC ..... 38/77.83

(58) Field of Classification Search
USPC ..... 38/74–77.83; 219/245, 248
See application file for complete search history.

(56) References Cited

U.S. PATENT DOCUMENTS

| | | | | |
|---|---|---|---|---|
| 2,515,100 | A * | 7/1950 | Sutton | 38/77.6 |
| 3,869,816 | A * | 3/1975 | Busby | 38/77.83 |
| 4,240,217 | A * | 12/1980 | Schwob | 38/77.83 |
| 4,720,306 | A * | 1/1988 | Emmert et al. | 134/3 |
| 4,854,059 | A * | 8/1989 | Ronchi | 38/93 |
| 5,433,034 | A * | 7/1995 | Bernstein | 38/103 |
| 7,392,607 | B2 * | 7/2008 | Vialle et al. | 38/77.6 |
| 7,779,564 | B2 * | 8/2010 | Valiyambath Krishnan et al. | 38/77.6 |
| 2003/0136434 | A1 | 7/2003 | Giovalle et al. | |
| 2005/0061352 | A1 * | 3/2005 | Yao | 132/225 |
| 2007/0064355 | A1 | 3/2007 | Vialle et al. | |

FOREIGN PATENT DOCUMENTS

| | | | |
|---|---|---|---|
| DE | 20017279 | U1 | 1/2001 |
| EP | 0821096 | A1 | 1/1998 |
| EP | 1191140 | A1 | 3/2002 |
| WO | 2007007241 | A1 | 1/2007 |

* cited by examiner

*Primary Examiner* — Ismael Izaguirre

(57) ABSTRACT

A steaming device includes a boiler configured for heating water to steam. A control device is provided for controlling a water flow to the boiler, and the boiler is provided with a rinsing drain for letting out rinsing water. A stopper is configured for covering the rinsing drain and for activating the control device. The stopper has a first position for starting a rinsing process, in which first position the rinsing drain is opened by the stopper and the stopper is configured to activate the control device. The stopper has a second position for ending the rinsing process, in which second position the rinsing drain is closed by the stopper and the stopper is configured to de-activate the control device.

17 Claims, 4 Drawing Sheets

STEAMING DEVICE WITH A RINSING FEATURE

FIELD OF THE INVENTION

The invention relates to a steaming device, in particular to rinsing of the steaming device.

BACKGROUND OF THE INVENTION

During operation of a steaming device, water is supplied to a boiler of the steaming device, wherein the water is heated to generate steam. As a consequence of heating, scale is usually formed in the boiler. This scale formation causes problems as the scale particles may get displaced from the boiler and may further be carried forward to an object that utilizes the steam. This may cause stains on the object. Furthermore, over a period of time, the water in the boiler gradually gets contaminated with ions. This is because of the fact that during the steam generation, only water is evaporated, while most of the other components which are present in the water stay behind. In a boiler containing contaminated water, foaming occurs during heating of the water, which disturbs the continuous supply of the steam by the boiler. This may also let out water along with the steam and may result in spitting from the boiler. If the scale is not periodically removed from the boiler, the water inlet and the steam outlet may clog resulting in a decreased performance of the boiler. Eventually, the boiler may not be fit for further use.

To solve this problem, a boiler having a drainage hole for manual rinsing is provided. When performing a rinsing process, a user has to pour water into the boiler, shake the boiler, and tilt and/or turn the boiler to obtain acceptable cleaning results. It is an arduous process, because of which only about 50% of users perform rinsing regularly.

WO2007007241 A1 discloses a steam ironing system comprising a steam iron and a boiler system having a boiler for generating steam, wherein the steam iron and the boiler are connected to each other through a steam hose. During operation of the boiler system, scale is formed in the boiler. For the purpose of removing the scale from the boiler, an automatic rinsing process is performed on the boiler system at regular intervals. During the rinsing process, a rinse valve connected to a water outlet positioned at a bottom of the boiler is opened, and water is discharged from the boiler to a rinse container. In the process, scale particles are carried along with the flow of water. Preferably, pressure is built up inside the boiler prior to opening the rinse valve, so that the water is forcibly ejected from the boiler, whereby the effectiveness of the rinsing process is enhanced. This system makes use of pumping with the rinse valve closed so a substantial pressure is developed in the boiler, after which the valve is opened to let out the pressurized water. The use of a rinse valve may be expensive and un-reliable as it can get choked with the scale particles. In such an auto-rinse process and other such processes, it is very difficult to make the user understand the limitations (for example: the waiting time and restriction on appliance usage during this period) imposed on him during the rinse process. Furthermore, a sequential operation of pressurizing and rinsing the boiler increases the time of rinsing.

SUMMARY OF THE INVENTION

It is an objective of the present invention to provide a steaming device which substantially improves the rinsing feature in terms of ease of usage.

In order to achieve this object, the invention proposes a steaming device comprising a boiler configured for heating water to steam, wherein a control device is provided for controlling a water flow to the boiler, and wherein the boiler is provided with a rinsing drain for letting out rinsing water; and a stopper for covering the rinsing drain and for activating the control device, wherein the stopper has a first position for starting a rinsing process, in which first position the rinsing drain is opened by the stopper and the stopper is configured to activate the control device and wherein the stopper has a second position for ending the rinsing process, in which second position the rinsing drain is closed by the stopper and the stopper is configured to de-activate the control device. The double function of the stopper substantially improves the rinsing feature in terms of ease of usage.

According to an embodiment of the invention, the stopper is a cap, a ball valve or the like. The term "stopper" is used to indicate a device of which a condition can be adjusted by being opened/removed, and by being closed/attached. In an opened or "removed" condition, the stopper is capable of letting pass a flow of a fluid or a mixture of fluids. In a closed or "attached" condition, the stopper blocks such a flow.

According to another embodiment of the invention, the control device comprises a valve. The term "valve" is used to indicate a device of which a condition can be adjusted. In an opened condition, the valve is capable of letting pass a flow of a fluid or a mixture of fluids. In a closed condition, the valve blocks such a flow.

When the stopper is in its first position, the rinsing process starts by opening the valve. The water flows to the boiler and then flows outside through the rinsing drain by virtue of the flow of incoming water from the water tank.

Besides ensuring an easy rinsing process, the valve between a water tank and the boiler has the advantage of easy filling of the boiler. Conventional (limited autonomy) steaming devices do not comprise a pump and the user has to directly fill water into the boiler. In such cases, to fill the boiler, the user needs to open a safety cap located at the top of the boiler to let the steam escape from the boiler. This poses two problems. The user has to wait for the boiler to cool before being able to open the safety cap. There is a possibility of an injury to the user due to the hot steam escaping from the safety cap while opening it. Providing the water tank and the valve in between the water tank and the boiler improves the method of filling the boiler. To be able to fill water the user can, preferably, operate the stopper slightly so as to open the valve connection between the water tank and the boiler but still keeping the rinsing drain closed. It should be noted that in such a condition (i.e. after having used the boiler for steaming), there is no air in the boiler, but substantially steam and water are present. Upon opening the valve, the left-over steam escapes from the boiler, via the valve and via the water tank to the atmosphere. After the escape of the steam, the pressure in the boiler reduces and the water from the water tank will be sucked in due to creation of vacuum, thus filling the boiler.

According to yet another embodiment of the invention, the control device comprises a pump. The term "pump" is used to indicate a device of which a condition can be adjusted. In a switched on condition, the pump is capable of pumping a fluid or a mixture of fluids. In a switched off condition, the pump blocks such a flow.

The steaming device may include a water tank configured for storing water, a boiler configured for heating the water to steam, a pump to deliver water from the water tank to the boiler and a stopper for covering the rinsing drain. The stopper has a first position for starting a rinsing process, in which position the rinsing drain is opened by the stopper and the stopper sends a first signal in order to activate the pump to deliver water into the boiler and the stopper has a second position for ending the rinsing process, in which position the rinsing drain is closed by the stopper and the stopper sends a second signal in order to de-activate the pump.

Preferably, the rinsing drain is positioned at a bottom of the boiler, so that it is possible to drain practically all of the water from the boiler. In the process, the water is allowed to flow from the boiler, through the rinsing drain, mainly under the influence of gravity and also by virtue of the flow of incoming water from the water tank. In this way, effective removal of scale particles and possibly other contaminants from the boiler is realized.

According to another embodiment of the invention, the steaming device further comprises a rinse indicator, wherein the rinse indicator is configured to i ndicate to a user a need for rinsing. The indicator may be of any nature, and may be a mechanical, electrical, electronic or electromechanical indicator. Indication may be based on time or extent of usage of the steaming device. The steaming device may be provided with a suitable controller, for example a microcontroller or a memory IC for monitoring an operation of the steaming device. Based on the input from the controller, rinse indicator indicates the user the need for rinsing. The indicator may be adapted to provide indication to the user in any suitable way, for example by providing an audible signal or a visible signal. Preferably, the indicator turns ON only when the temperature of the boiler is below a pre-determined value.

According to a further embodiment of the invention, the boiler is configured to release the steam when the stopper is in a position between the first and second position. The released steam is directed into the water tank. When the stopper is partially opened, the valve between the boiler and the water tank gets opened partially and releases the steam of the boiler to the atmosphere through the water tank. Thus the user is not exposed to hot steam when he/she accidentally opens the stopper while the boiler is hot because by the time he fully opens the stopper, the steam would have escaped through the valve.

According to a still further embodiment of the invention, the device further comprises a rinse container for receiving water from the boiler and containing the water, wherein the rinse container is removably arranged at an outside of the stopper. When a steaming device having a rinse container is subjected to rinsing process, the water that is used in the process is received in the rinse container and remains in the container until a user removes the container from the boiler and throws the water out. An advantage of the rinse container is that there is no need for positioning the outlet of the boiler or a discharge member connected to the outlet of the rinsing drain above a separate container or a sink or the like when the rinsing process is carried out.

According to a preferred embodiment of the invention, an ironing system comprises the above-mentioned steaming device. The primary function of the system iron is to generate steam from water. The water leaves behind salts and other impurities or components that it carries. Over the time of usage, these impurities and salts (dissolved as well as precipitated) cause various problems—ejecting scale from the iron, ejecting dirty hot water from the iron (due to foaming) and staining an object to be ironed. Rinsing of boiler is essential for smooth functioning of the system iron.

The present invention will now be explained in greater detail with reference to the figures, in which similar parts are indicated by the same reference signs.

DETAILED DESCRIPTION OF EMBODIMENTS OF THE INVENTION

Figure 1A:
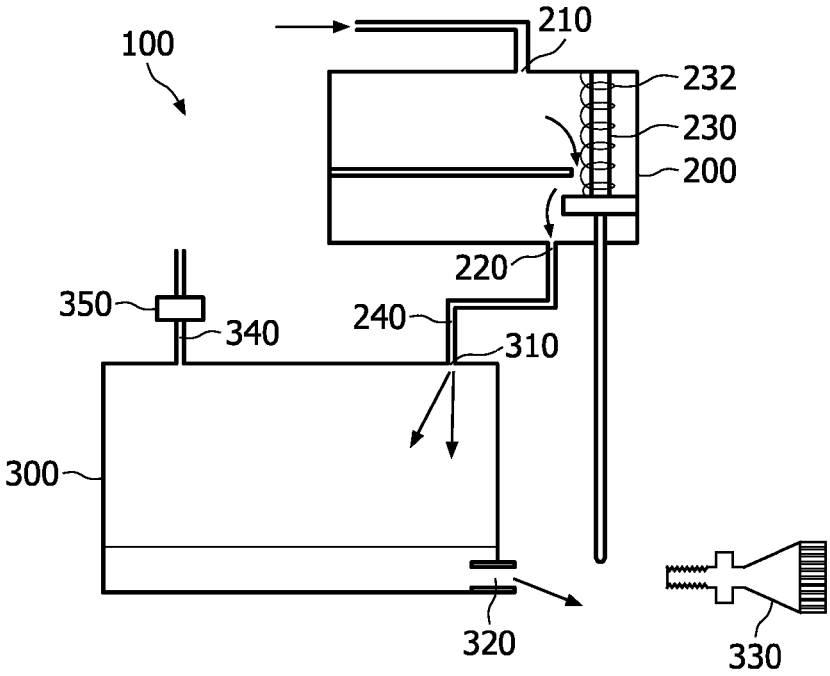
FIG. 1*a* shows a steaming device according to an embodiment of the invention wherein a stopper is in its first position.

The present invention will be described with respect to particular embodiments and with reference to certain drawings but the invention is not limited thereto. Any reference signs in the claims shall not be construed as limiting the scope. The drawings described are only schematic and are non-limiting. In the drawings, the size of some of the elements may be exaggerated and not drawn on scale for illustrative purposes. Where the term "comprising" is used in the present description and claims, it does not exclude other elements or steps. Where an indefinite or definite article is used when referring to a singular noun e.g. "a" or "an", "the", this includes a plural of that noun unless something else is specifically stated.

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

Figure 1B:
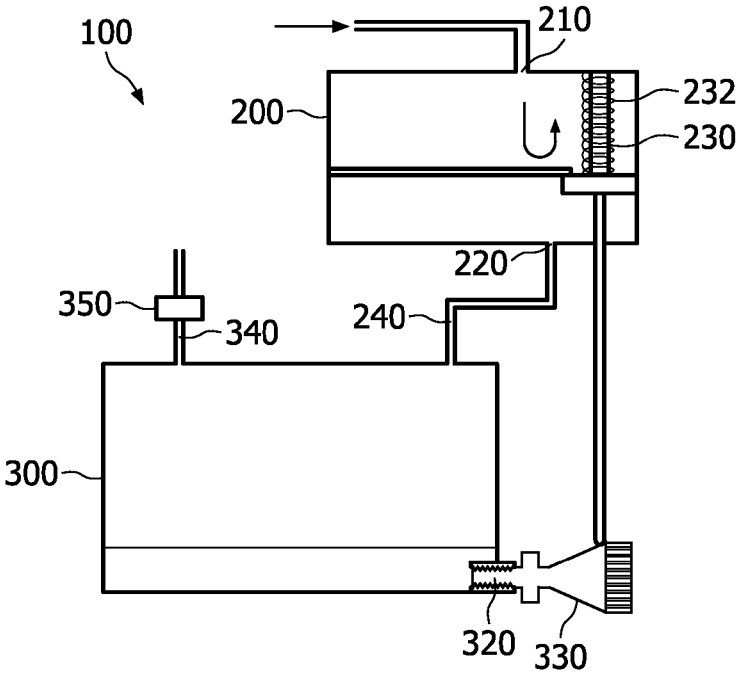
FIG. 1*b* shows the steaming device of FIG. 1*a* wherein the stopper is in its second position.

As shown in FIG. 1*a* and in FIG. 1*b*, a steaming device 100 includes a water tank 200 and a boiler 300. The water tank 200 is provided with a water inlet 210, a water outlet 220 and a valve 230. A spring 232 pushes open the valve 230 upon a trigger. The boiler 300 is provided with an inlet 310 and is coupled to the outlet 220 of the water tank via a channel 240. The boiler 300 has a rinsing drain 320 which is covered by a stopper 330. The boiler has a steam outlet 340 coupled to a steam outlet valve 350, which may, for instance, be an electrically activated valve.

Figure 2A:
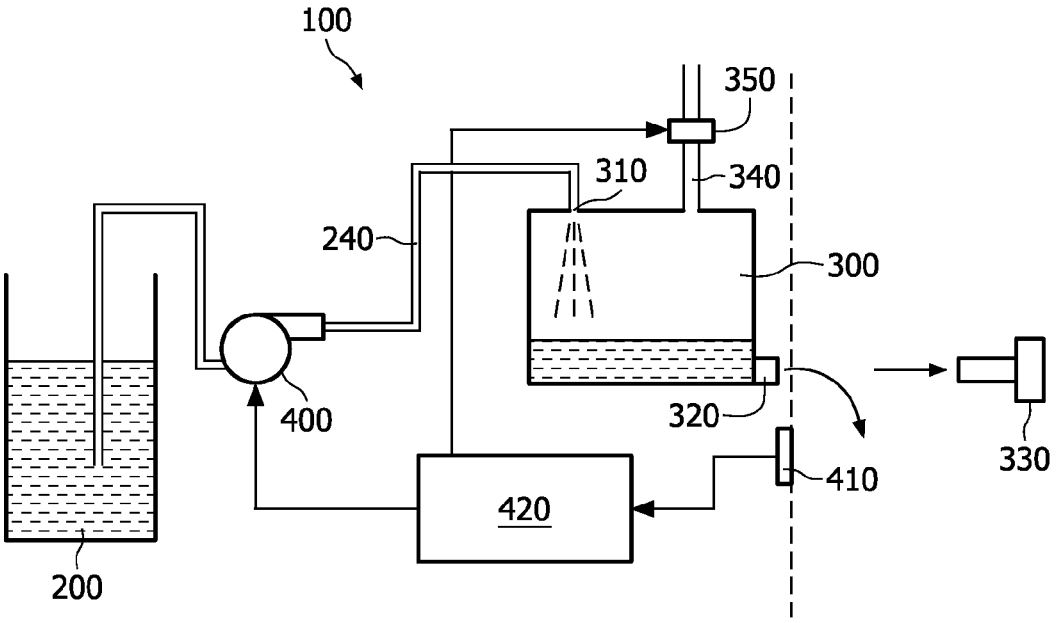
FIG. 2*a* shows a steaming device according to another embodiment of the invention wherein a stopper is in its first position.
Figure 2B:
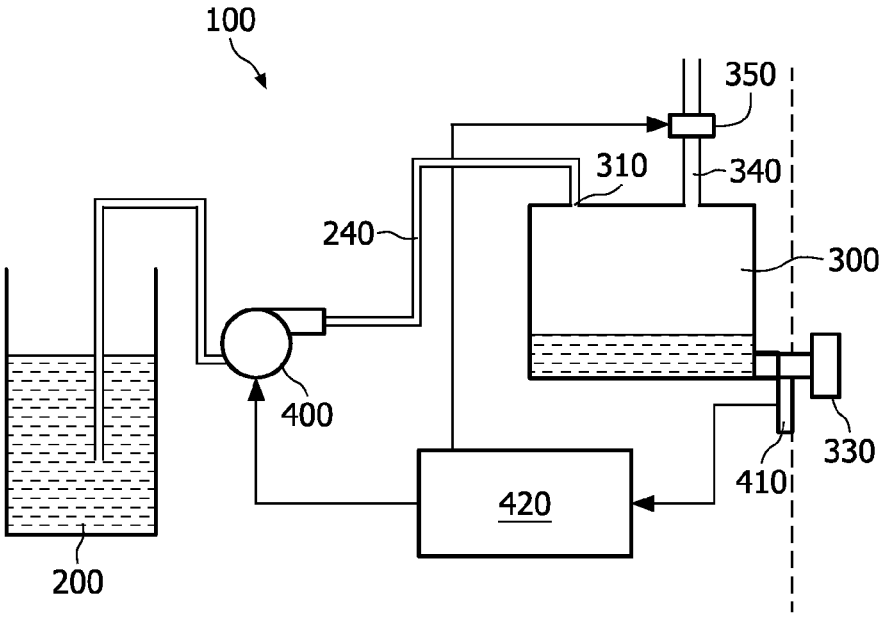
FIG. 2*b* shows the steaming device of FIG. 2*a* wherein the stopper is in its second position.

FIG. 2*a* and FIG. 2*b* show a steaming device 100 including a pump 400 connecting the boiler 300 and the water tank 200. The stopper 330 is also coupled to a switch 410. The switch is connected to the pump 400 via a controller 420.

Figure 3A:
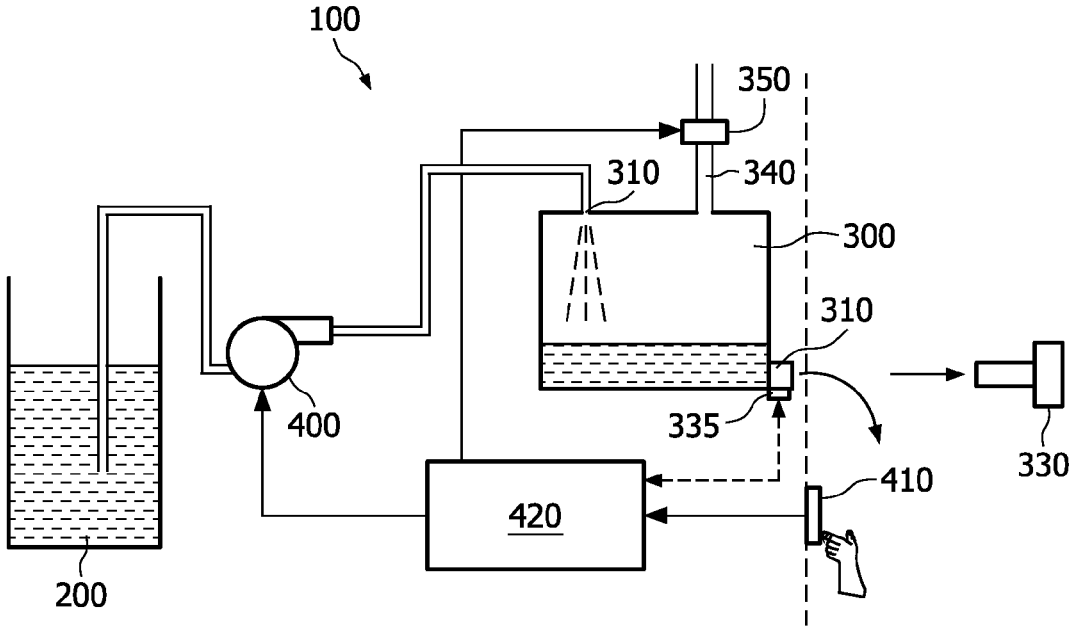
FIG. 3*a* shows a steaming device according to a further embodiment of the invention wherein a stopper is in its first position.
Figure 3B:
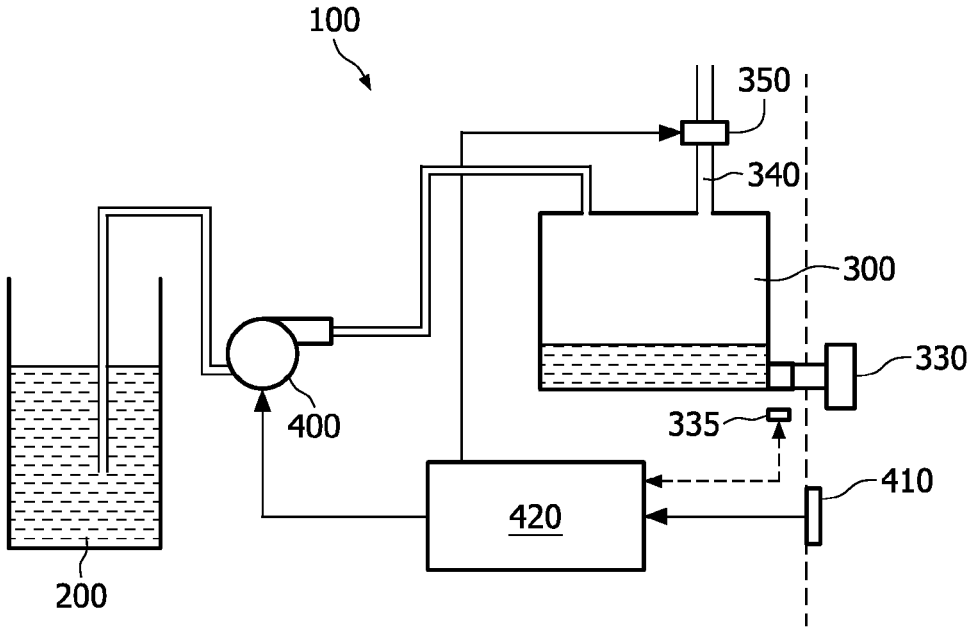
FIG. 3*b* shows the steaming device of FIG. 3*a* wherein the stopper is in its second position.

FIG. 3*a* and FIG. 3*b* are also similar to FIG. 2*a* and FIG. 2*b* except that the switch 410 is not coupled to the stopper.

Figure 4:
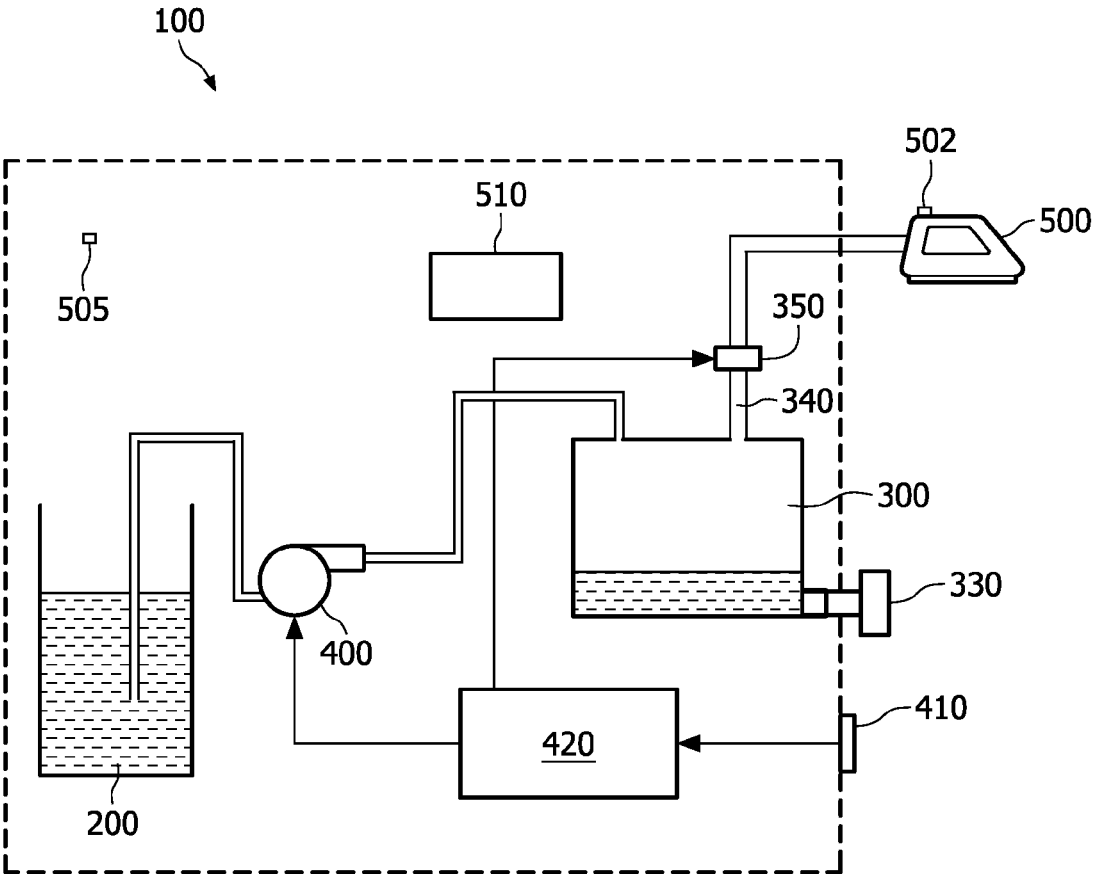
FIG. 4 shows a system iron comprising a steaming device.

FIG. 4 is similar to any of the above-mentioned figures except that the steaming device 100 is now connected to a system iron 500 via the steam outlet 340 and the steam outlet valve 350. The system iron is provided with a steam trigger 502. A micro-controller 510 is arranged to monitor the performance or usage of the steaming device 100. The microcontroller feeds this information to a rinse indicator 505 situated on the system iron 500 or on the stand housing the boiler.

The principle used in all the executions is to rinse and flush the boiler 300, allowing removal of scale particles as well as flush out the water containing high amounts of total dissolved salts, by means of a stopper that controls both the inflow and the outflow of rinsing water.

A complete mechanical execution can be performed without use of electricity for the rinsing function, as shown in FIG. 1*a* and FIG. 1*b*. The valve 230 allows water from the water tank 200 to flow into the boiler 300 when the stopper 330 is in its first position. The rinsing process has the following steps. A user sees the rinse indication on the indicator (not shown) (for example blinking lamp and/or text or graphic display) and opens the stopper 330 covering the rinse drain 320 as shown in FIG. 1*a*. When the stopper is opened and is in its first position, a spring pushes open the valve 230 such that water can enter into the boiler 300 and flush the boiler. The water is flushed out through the rinsing drain 320. The user uses a tray (external), sink, or the system's internal tray (not shown) to collect the rinse water. After the completion of rinsing, the user places back the stopper 330 as shown in FIG. 1*b*. When the stopper 330 is in its second position, the valve 230 is kept closed such that, through the valve 230, neither water can enter into the boiler 300 nor steam can exit from the boiler 300.

When the stopper 330 is opened and when the boiler 300 is hot, there is a risk of injury due to burns by the hot water or steam exiting. In a conventional boiler, the stopper 330 is opened only after the boiler 300 is cold enough. In this steaming device 100, when the stopper 330 is in a position between the first and second positions, i.e., when the stopper 330 is partially opened, the valve 230 releases the steam from the boiler 300 to the water tank 200 through the valve 230. This reduces the pressure inside the boiler 300 significantly. This feature has another advantage. It enables easy filling of the boiler 300. To be able to fill the boiler 300 with water the user can preferably partially open or unscrew the stopper 330 so as to open the valve 230 between the water tank 200 and the boiler 300. It should be noted that in such a condition (i.e. after having used the boiler for steaming), there is no air in the boiler 300, substantially steam and water are present. Upon opening the valve 230 and after the steam escapes to the atmosphere via the valve 230 and the water tank 200, the water from the water tank 200 will be sucked in due to creation of vacuum, thus filling the boiler 300. Thus water filling becomes easy and can be achieved even without a pump. With the valve 230 between the water tank 200 and the boiler 300, the water tank 200 can be anywhere, not necessarily at the top of the boiler 300 as the water flows to the boiler 300 from the water tank 200 by virtue of vacuum created in the boiler, not necessarily by virtue of gravity.

Additionally, there can be means to avoid activation of the valve 230 when there is no water inside the water tank 200. There can be a floater assembly that blocks the activation of the valve 230 via the change in position of the stopper 330 when the water tank 200 is empty.

The rinsing process can also be executed electrically as shown in FIG. 2*a*, 2*b* and FIG. 3*a*, 3*b* where the user performs rinsing while the device is still plugged in. This involves use of the pump 400 to flush water through the boiler 300. The activation of the pump is achieved in various ways. The act of removing the stopper 330 can activate the pump as shown in FIG. 2*a*. On the other hand, the user can remove the stopper 330 and then activate the pump by pressing the switch 410 as shown in FIG. 3*a*. The steaming device of FIG. 3*a* and FIG. 3*b* is provided with a stopper removal detection means 335.

The rinsing process according to FIG. 2*a* has the following steps. The user sees the rinse indication on the indicator (not shown) (blinking lamp/other display) and he opens the stopper 330. The switch 410 coupled to the stopper 330 gets switched on and a signal is sent to the controller 420 which in turn switches on the pump 400. The user places a tray to collect water, if there is no inbuilt tray to collect this water. After the rinsing process, the user places the stopper 350 back as shown in FIG. 2*b* and this switches off the pump 400 automatically. In another execution, upon receiving the signal from the controller 420, the pump turns ON for a predetermined period of time and can stop itself without requiring the stopper to be replaced in position for de-activation of pumping.

The rinsing process can also be executed as shown in FIG. 3*a*. The user sees the rinse indicator blinking/display and he opens the stopper 330. This is detected by the stopper removal detection means 335. The user presses the switch 410 which is beside the stopper 330. As the switch 410 is pressed, the pump 400 gets switched on via the controller 420. The pump 400 starts flushing and rinsing the boiler 300 with water. This continues for a user-determined amount of time, after which the user stops pressing the switch 410 and fixes back the stopper 330 as shown in FIG. 3*b*. The rinsing process then ends. At any time during the usage, the user can stop pressing the switch 410 (for example to change the container to collect water). Preferably, when the stopper removal is not detected by the detection means 335, pressing of switch 410 will not result in the pumping by the pump 400. This forms a safety feature to avoid pumping of water due to accidental pressing of switch 410 during normal usage. Optionally, a signal (visual or audible) may then be given to prompt the user to fix back the stopper 330. Additionally, there can be means to avoid activation of the pump 400 when there is no water inside the water tank 200. This can be easily achieved by blocking a signal from the switch 410 to the controller 420 when the water tank 200 is empty, as detected by another sensor (for instance magnetic float based sensor) that senses the water level in the water tank. In another execution, the pump 400 can stay on for a pre-determined period of time once it receives a signal from the user. Further, there can be means to continuously sense the presence of the rinse container and stop the pump 400 when the rinse container is absent.

The steaming device 100 can be connected to a system iron 500 as shown in FIG. 4. When the user presses the steam trigger 502, the steam is delivered to the system iron 500 from the steaming device 100. The micro-controller 510 can monitor the time for which the steam trigger 502 is pressed. When the steam trigger 502 is pressed, the steam outlet valve 350 gets opened. The rinse indicator 505 may blink (and/or beep) or give a display at a pre-determined interval of steaming or usage time, for instance every ten hours the steam outlet valve 350 is opened. In such a case, the steaming device 100 comprises measuring means (not shown) for measuring the time for which the steam outlet valve 350 is opened, and the micro-controller 510 is adapted to keeping record of a total length of the time of the opened condition of the steam outlet valve 350. The micro-controller compares the total length of time for which the steam outlet valve 350 is in opened condition to the pre-determined length of time (for instance 10 hours). The rinse indicator blinks/displays in case the total length of time of the opened condition of the steam outlet valve 350 has reached the pre-determined length of time. This is an accurate manner of determining the time when a rinsing process should be performed.

Another method for determining an appropriate moment for triggering a rinsing process, which is applicable for the steaming devices of FIGS. 2*a* and 3*a* comprising a pump 400 for supplying water to the boiler 300, comprises the steps of determining the total time of operation of the pump 400, and comparing the total time to a pre-determined time.

It is also possible to apply an indirect method of determining the moment at which a rinsing process may be initiated. For example, the number of times the boiler 300 is operated is counted, and the rinsing process is initiated when the total number of times of operation has reached a pre-determined number. In order to achieve a greater accuracy when the above-described indirect method is applied, the temperature of the boiler 300 is measured at various positions. As scale builds up inside the boiler, it acts like a thermal barrier, as a result of which the temperature distribution is disturbed. Thus, by measuring the temperature at various positions, it is possible to find out if the temperature distribution is still within normal limits, or not. In the latter case, an indication that the rinsing process should be performed is obtained.

In one of the many possible embodiments, the steaming device may have a processing unit that takes input from either the number of times the water tank 200 is engaged and disengaged into the steaming device.

Based on any one of the above-mentioned inputs, the rinse indicator 505 blinks or provides a display and the user performs the rinsing process by removing the stopper 330. Based on these inputs, the micro-controller 510 lights up the rinse indicator 505, for example, an LED, located at the front of the system iron 500, or the housing of the boiler. The rinse indicator 505 will reset after it detects the beginning of the rinsing process (by the virtue of sensing the removal of the stopper 330 or pressing of the switch 410.).

It is to be understood that although preferred embodiments, specific constructions and configurations have been discussed herein according to the present invention, various changes or modifications in form and detail may be made without departing from the scope of this invention as defined by the claims. For example, the fact that the claims recite a first and a second position of the stopper does not preclude the stopper from having a third position e.g. to allow water to flow into the boiler to be heated to steam in normal operation of the steaming device, while the rinsing drain is closed. A single unit may fulfill the functions of several items recited in the claims. The mere fact that certain measures are recited in mutually different dependent claims does not indicate that a combination of these measured cannot be used to advantage.

The invention claimed is:

1. A steaming device comprising:

a boiler configured for heating the water to steam, wherein a control device is provided for controlling the water flow to the boiler, and wherein the boiler is provided with a rinsing drain for letting out rinsing water; and a stopper for covering the rinsing drain and for activating the control device, wherein the stopper has a first position for starting a rinsing process, wherein in the first position the rinsing drain is opened by the stopper and the stopper is configured to activate the control device, and wherein the stopper has a second position for ending the rinsing process, in which second position the rinsing drain is closed by the stopper and the stopper is configured to de-activate the control device.

2. The steaming device of claim 1, wherein the stopper is a cap, or a ball valve.

3. The steaming device of claim 1, wherein the control device comprises a valve.

4. The steaming device of claim 1, wherein the control device comprises a pump.

5. The steaming device of claim 1, wherein the rinsing drain is provided at a lower part of the boiler.

6. The steaming device of claim 1, further comprising a rinse indicator, wherein the rinse indicator is configured to indicate to a user a need for rinsing.

7. The steaming device of claim 1, wherein the boiler is configured to release the steam when the stopper is in a position between the first and second position.

8. The steaming device of claim 7, wherein the released steam is directed into a water tank.

9. The steaming device of claim 1, wherein the device further comprises a rinse container for receiving water from the boiler and containing the water, wherein the rinse container is removably arranged at an outside of the rinsing drain.

10. An ironing system comprising a steaming device, wherein the steaming device comprises:

a boiler configured for heating the water to steam, wherein a control device is provided for controlling the water flow to the boiler, and wherein the boiler is provided with a rinsing drain for letting out rinsing water; and a stopper for covering the rinsing drain and for activating the control device, wherein the stopper has a first position for starting a rinsing process, wherein in the first position the rinsing drain is opened by the stopper and the stopper is configured to activate the control device, and wherein the stopper has a second position for ending the rinsing process, in which second position the rinsing drain is closed by the stopper and the stopper is configured to de-activate the control device.

11. The ironing system of claim 10, wherein the stopper is a cap, or a ball valve.

12. The ironing system of claim 10, wherein the control device comprises a valve.

13. The ironing system of claim 10, wherein the control device comprises a pump.

14. The ironing system of claim 10, wherein the rinsing drain is provided at a lower part of the boiler.

15. The ironing system of claim 10, further comprising a rinse indicator, wherein the rinse indicator is configured to indicate to a user a need for rinsing.

16. The ironing system of claim 10, wherein the boiler is configured to release the steam when the stopper is in a position between the first and second position and the released steam is directed into a water tank.

17. The ironing system of claim 10, wherein the device further comprises a rinse container for receiving water from the boiler and containing the water, wherein the rinse container is removably arranged at an outside of the rinsing drain.

* * * * *